US007753718B2

(12) United States Patent
Bethurum et al.

(10) Patent No.: US 7,753,718 B2
(45) Date of Patent: Jul. 13, 2010

(54) ELECTRICAL DISCONNECT WITH PUSH-IN CONNECTORS

(75) Inventors: Gary C. Bethurum, Murrieta, CA (US); Benjamin D. Swedberg, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 12/237,021

(22) Filed: Sep. 24, 2008

(65) Prior Publication Data

US 2009/0017694 A1 Jan. 15, 2009

Related U.S. Application Data

(63) Continuation of application No. 11/425,440, filed on Jun. 21, 2006.

(60) Provisional application No. 60/741,222, filed on Dec. 1, 2005, provisional application No. 60/692,631, filed on Jun. 21, 2005.

(51) Int. Cl.
*H01R 4/24* (2006.01)

(52) U.S. Cl. ..... 439/441; 439/293

(58) Field of Classification Search ..... 439/441, 439/439, 293, 289, 295, 357, 358
See application file for complete search history.

(56) References Cited

U.S. PATENT DOCUMENTS 2,384,267 A * 9/1945 Andersen ..... 439/293
2,386,177 A 10/1945 Andersen
2,720,634 A 10/1955 Hart
2,838,739 A * 6/1958 Winkler ..... 439/295
3,093,433 A 6/1963 Ege
3,208,030 A 9/1965 Evans et al.
3,324,447 A * 6/1967 Pistey ..... 439/441
3,337,836 A 8/1967 Churla, Jr.
3,827,007 A 7/1974 Fairbairn et al.
3,945,711 A 3/1976 Hohorst et al.
4,186,988 A 2/1980 Kobler
4,295,184 A 10/1981 Roberts
4,370,013 A 1/1983 Niitsu et al.
4,397,514 A 8/1983 Durand et al.
4,431,244 A 2/1984 Anhalt et al.
4,537,456 A 8/1985 Brown et al.

(Continued)

FOREIGN PATENT DOCUMENTS

DE 29623742 U1 11/1999

(Continued)

*Primary Examiner*—Hien Vu
(74) *Attorney, Agent, or Firm*—Cook Alex Ltd.

(57) ABSTRACT

A wire connector has an enclosure including a housing and a cap and one or more contacts supported in the enclosure. The contacts each have outer ends opposite wire ports in the cap to receive a stripped end of a wire in a push-in engagement. One set of contacts has a male blade and the other set of contacts has a female socket at the inner or forward ends thereof. The housings are arranged so that two housings are releasably engagable with one another. When two housings are engaged the male contacts electrically engages the female contacts of the other housing. The female contacts include a sacrificial tine that is always first to make and last to break engagement with the male contact so that any degradation due to arcing always occurs at the sacrificial tine.

7 Claims, 14 Drawing Sheets

U.S. PATENT DOCUMENTS 4,552,425 A 11/1985 Billman
4,566,748 A 1/1986 Tanishi et al.
4,566,749 A 1/1986 Johnston
4,659,158 A 4/1987 Sakamoto et al.
4,673,232 A 6/1987 Kubota
4,818,237 A 4/1989 Weber
4,824,395 A 4/1989 Blaha
4,952,167 A 8/1990 Hertelendy
4,963,102 A 10/1990 Gettig et al.
4,973,263 A 11/1990 Nielsen
4,978,316 A 12/1990 Yahata
4,979,910 A 12/1990 Revil et al.
4,993,967 A 2/1991 Matsumoto
5,137,466 A 8/1992 Endo et al.
5,164,545 A 11/1992 Krienberg et al.
5,167,528 A 12/1992 Nishiyama et al.
5,234,356 A 8/1993 Macjima et al.
5,238,427 A 8/1993 Fry et al.
5,314,347 A 5/1994 Colleran et al.
5,342,221 A 8/1994 Peterson
5,342,226 A 8/1994 Hayes et al.
5,350,316 A 9/1994 Wagener et al.
5,409,395 A 4/1995 Okada
5,454,730 A 10/1995 Tozuka
5,463,540 A 10/1995 Jones
5,488,268 A 1/1996 Bauer et al.
5,575,678 A 11/1996 Okumura et al.
5,605,472 A 2/1997 Sakai et al.
5,613,881 A 3/1997 Ichida et al.
5,624,271 A 4/1997 Childs et al.
5,632,645 A * 5/1997 Love ..... 439/441
5,769,672 A 6/1998 Flieger
5,788,527 A 8/1998 Sanders et al.
5,797,772 A 8/1998 Sakurai et al.
5,895,286 A 4/1999 Linke
5,934,946 A 8/1999 Nakamura
5,975,940 A 11/1999 Hartmann et al.
5,997,334 A 12/1999 Goto
5,997,366 A 12/1999 Libregts
6,039,597 A 3/2000 Getselis et al.
6,039,615 A 3/2000 Suzuki
6,065,987 A 5/2000 Bigotto
6,074,242 A 6/2000 Stefaniu et al.
6,083,057 A 7/2000 Annecke et al.
6,093,059 A 7/2000 Bogese
6,128,181 A 10/2000 Higami
6,132,233 A 10/2000 Fukuda
6,200,168 B1 3/2001 Ko
6,254,422 B1 7/2001 Feye-Hohmann
6,257,919 B1 7/2001 Cutler et al.
6,280,233 B1 8/2001 Beege et al.
6,293,831 B1 9/2001 Yamatani
6,336,824 B1 1/2002 Sorig
6,514,098 B2 2/2003 Marpoe, Jr. et al.
6,540,529 B1 4/2003 Yu
6,570,306 B2 5/2003 Henrici et al.
6,589,082 B2 7/2003 Harasawa et al.
6,652,303 B2 11/2003 Stockel et al.
6,746,286 B2 6/2004 Blaha
6,783,385 B2 8/2004 Rudy
6,832,938 B2 * 12/2004 Lenker ..... 439/835
6,846,188 B2 1/2005 Hsin et al.
6,913,494 B2 7/2005 Ward et al.
7,210,970 B1 5/2007 Pellon et al.
7,255,592 B1 8/2007 Tseng
7,278,890 B1 10/2007 Smutny et al.
7,281,942 B2 10/2007 Swedberg et al.
7,287,999 B2 10/2007 Holterhoff et al.
7,470,143 B2 * 12/2008 Osborn et al. ..... 439/441
7,488,196 B2 2/2009 Kocher et al.
7,497,721 B2 3/2009 Lauermann et al.
2003/0017747 A1 1/2003 Blanchfield et al.
2004/0157476 A1 8/2004 Maldonado et al.
2005/0042901 A1 2/2005 Minich et al.
2005/0104524 A1 5/2005 Bishop
2005/0164552 A1 7/2005 Wlos et al.
2006/0063419 A1 3/2006 Steinkemper et al.
2006/0217003 A1 9/2006 Martin et al.
2006/0286864 A1 12/2006 Bethurum et al.
2007/0099480 A1 * 5/2007 Fabian et al. ..... 439/441
2007/0249215 A1 10/2007 Osborn et al.
2008/0020628 A1 1/2008 Kikuchi

FOREIGN PATENT DOCUMENTS

DE 29920231 U1 4/2001
GB 2294817 A 5/1996

* cited by examiner

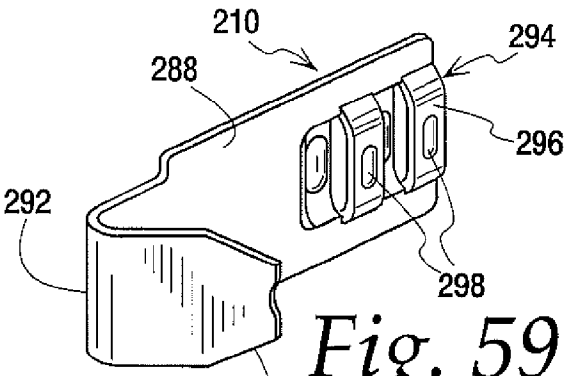
Fig. 59
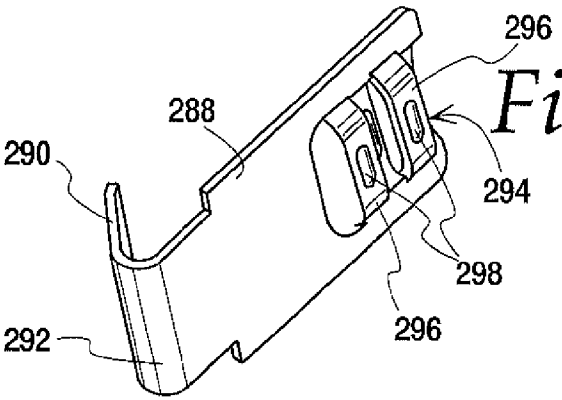
Fig. 59A
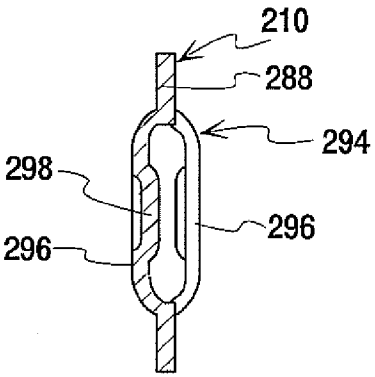
Fig. 64
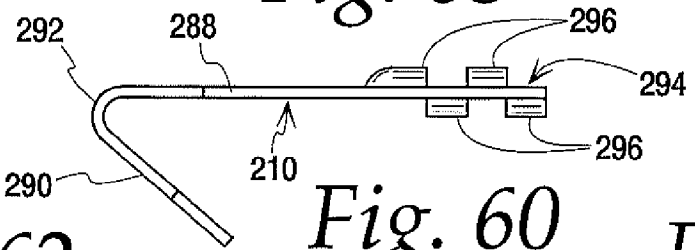
Fig. 63
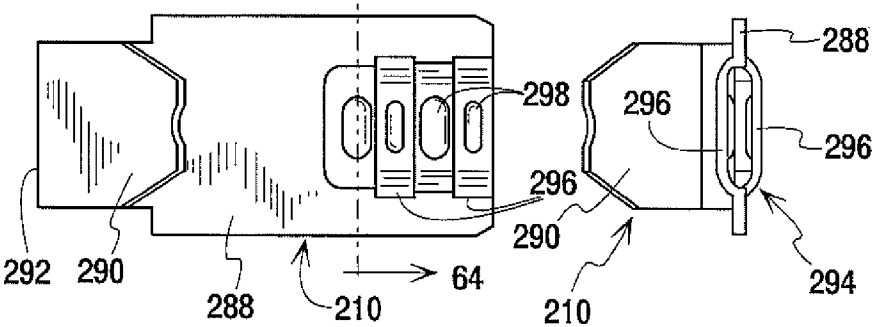
Fig. 61
Fig. 60
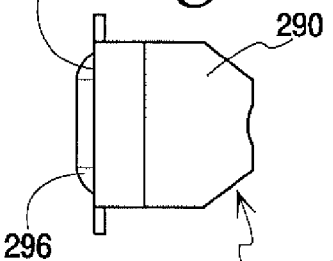
Fig. 62

ELECTRICAL DISCONNECT WITH PUSH-IN CONNECTORS

CROSS-REFERENCES TO RELATED APPLICATIONS

This application claims the benefit of U.S. application Ser. No. 60/692,631, filed Jun. 21, 2005 and U.S. application Ser. No. 60/741,222, filed Dec. 1, 2005 and is a continuation application of U.S. application Ser. No. 11/425,440, filed Jun. 21, 2006.

BACKGROUND OF THE INVENTION

This invention concerns a disconnect for electrical circuits. It incorporates a plug and socket combination that provides a convenient and safe way to replace circuit elements in live circuits. A common, but by no means exclusive, application for the disconnect is in non-residential fluorescent light fixtures. Such fixtures require a ballast to operate. Ballasts are typically hard-wired between the power supply and the fluorescent tubes. When a ballast fails it has to be replaced. Traditionally this has been performed by an electrician who cuts the wires to the failed ballast and removes the old ballast. The electrician then installs a new ballast, strips the wire ends, and connects the new ballast's wires to the power supply and tube sockets using suitable twist-on connectors such as those sold by IDEAL Industries, Inc. under their trademarks WIRE-NUT® and TWISTER®. Often this is done in offices, factories, commercial or retail spaces or other facilities where shutting down the power to the fixture is not a practical option. Thus, ballasts are frequently replaced in live circuits. This leaves no room for error on the part of the electrician. Unfortunately, electricians occasionally do make errors which result in personal injury and/or property damage.

The National Electrical Code (NEC) section 410.73(G) addresses the problem of replacing ballasts for non-residential fluorescent fixtures in live circuits. It requires a disconnect that simultaneously removes all conductors of the ballast from the source of supply. It also states that the line side terminals of the disconnect shall be guarded.

The available technology for meeting the NEC requirements includes pin and socket connectors. While such connectors meet the basic requirements they have several disadvantages. They are not rated for solid wire. They require crimping by the electrician. The labor costs of crimping and assembling the connectors is high and the cost of the connectors themselves is high. Insulated terminals provide the lowest cost option but these fail to meet the code requirements of simultaneous disconnect of all wires. Furthermore, insulated terminals are not rated for solid wire and they require crimping by the electrician with its attendant labor cost.

What is needed is a disconnect that fully meets the NEC code requirements but does not add labor cost at the factory or in the field. The technology should be familiar to factory personnel as well as electricians, with no special tools required by either. The disconnect should work with either solid or stranded wire and it should minimize the total installed cost.

SUMMARY OF THE INVENTION

The present invention is an electrical disconnect having push-in connectors. The disconnect meets the objectives previously set forth. The disconnect can be used in any electrical circuit where quick, convenient and replaceable connections to the circuit are desirable. It is particularly suited for use in connecting fluorescent light ballasts, although it could be used in a wide variety of other applications as well.

One object of the invention is a wire connector of the type described including contacts having at least one flexible spring finger for engaging a conductor inserted into the enclosure. Some of the contacts also have a socket which is split to define main tines and a sacrificial tine. The sacrificial tine is arranged such that it is first to make and last to break contact with a blade moved into and out of the enclosure, thereby exposing the sacrificial tine to all potential arcing and preventing any arcing to the main tines.

The disconnect in this embodiment has an enclosure formed by a housing and cap. The housing is arranged to releasably engage a facing housing. Male and female contacts are mounted in the enclosure. At a forward end the male contact has a blade. At a forward end the female contact has a socket for removably receiving the blade of a second, mating enclosure. At the rear ends of both the male and female contacts there are integrally formed push-in connector elements for receiving a conductor or wire. The housings optionally have mating hooks and latches that releasably hold the housings together when joined. The hooks are formed on flexible latch arms that can be depressed to release the hooks and permit separation of the housings. The latch arms are arranged so they can be released with one hand.

Another aspect of the present invention concerns the enclosure provided by the housing. Each push-in contact is shielded by its own, individual compartment. This enhances safety by preventing shorting from one contact to another. No contact is exposed to any other contact because a compartment wall intervenes between any two contacts. Thus, the contacts are shielded not only to the exterior of the housing, but also from any internal shorting paths as well. The contacts are shielded both at the front and rear and whether the housings are engaged or disengaged.

Yet another feature of the invention is the disconnect can be used with a range of wire sizes and types. Solid or stranded wire from 12 AWG to 18 AWG can be used. The housings have built into them a deflection limiter that prevents a large wire size from flexing the spring fingers of the contacts past their elastic limit. The housings also have wire receptacle boxes that constrain the final location of inserted conductors. This limits movement of the wire within the housing. It also prevents splaying of stranded wires that could reduce the holding force of the spring fingers if it were allowed to occur.

BRIEF DESCRIPTION OF THE DRAWINGS

FIGS. 59 and 59A are perspective views of the female contact of the FIG. 30 disconnect.

FIG. 60 is a side elevation view of the female contact.

FIG. 61 is a right end elevation view of the female contact.

FIG. 62 is a left end elevation view of the female contact.

FIG. 63 is a top plan view of the female contact.

FIG. 64 is a section taken along line 64-64 of FIG. 60.

DETAILED DESCRIPTION OF THE INVENTION

Figure 1:
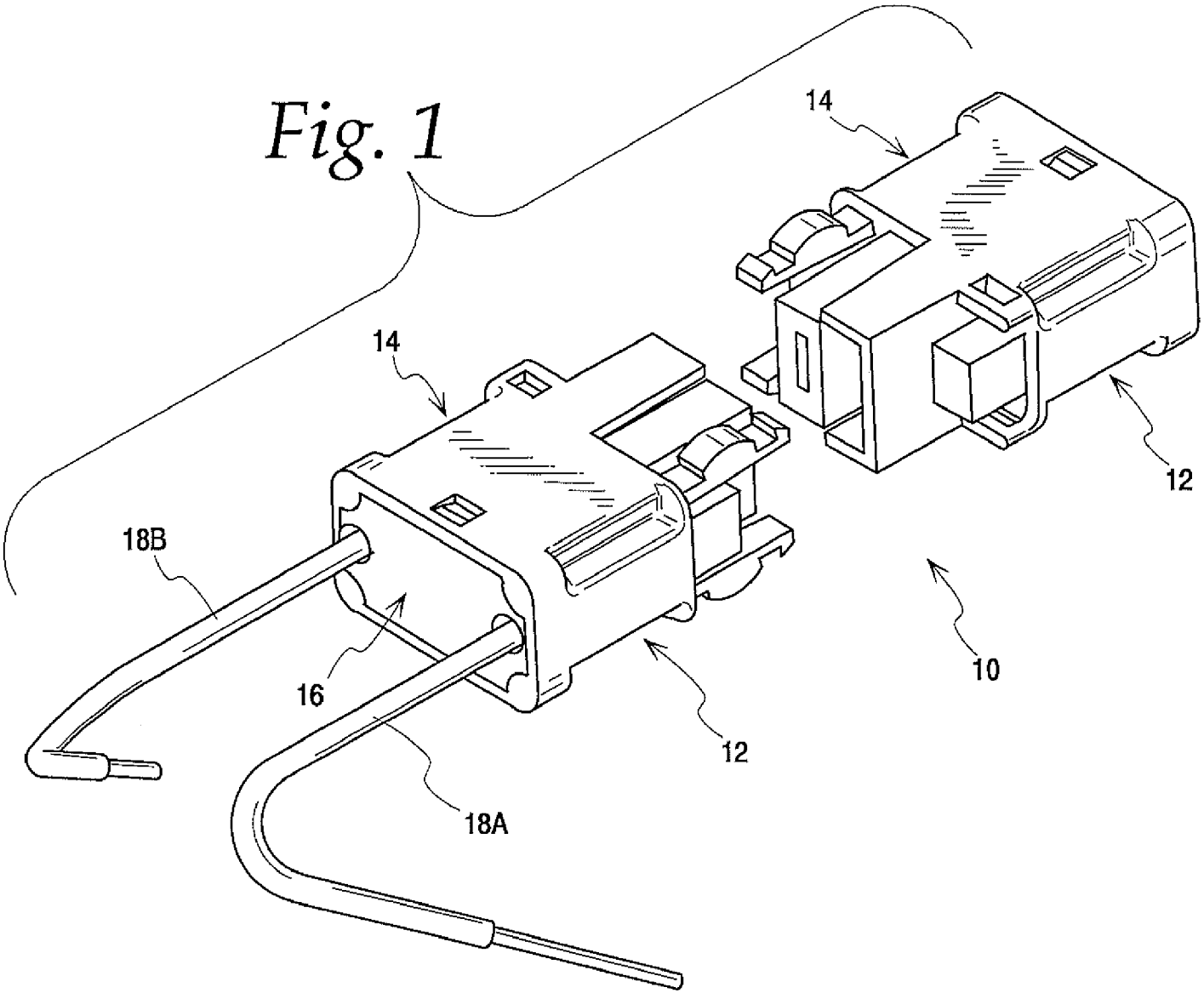
FIG. 1 is an exploded perspective view of the electrical disconnect of the present invention, with a pairs of wires installed in one of the housings thereof.
Figure 3:
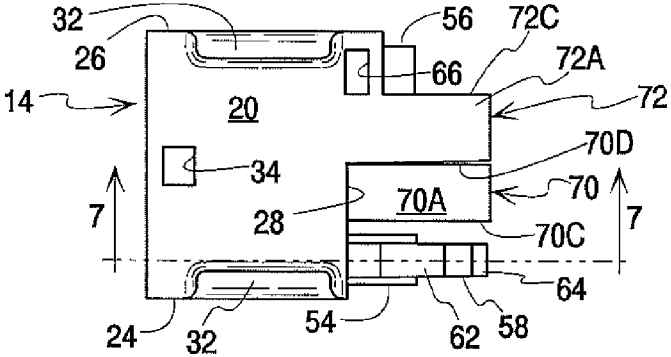
FIG. 3 is a top plan view of the housing.

FIG. 1 illustrates the electrical disconnect of the present invention generally at 10. The complete disconnect includes two identical enclosures 12. Each enclosure includes a housing 14 and a cap 16. The housing can be thought of as a generally five-sided shell with a sixth, outer side that is open to a hollow interior. The cap 16 fits into the shell to close the otherwise open outer end of the housing. Each enclosure also has mounted therein male and female contacts (not shown in FIG. 1). The contacts each have a wire engaging finger at their outer ends and one of a blade or socket at the inner ends. First and second extensions at the inner end of the housing enclose the socket and blade. Wires 18A and 18B electrically connect to the contacts with push-in connections. That is, bare conductors at the ends of the wires are pushed into ports in the cap 16 and engage the finger of a contact. The housing extensions can be releasably plugged into one another to electrically connect the contacts by joining the blade of one enclosure with the socket of the other enclosure.

Details of the housing 14 are shown in FIGS. 2-7. The basic structural unit of the housing is a five-sided, hollow box including top and bottom walls 20 and 22. These are joined by side walls 24 and 26. A cross wall 28 completes the box. Internal fillets 30 (FIGS. 5 and 6) at the intersections of these walls strengthen the box and provide a surface against which pins in the molding tool can push the finished housing out of the mold. Cutouts 32 on the exterior corners where the side walls meet the top and bottom walls reduce the amount of material needed to mold the part. The longitudinal extent of the cutouts 32 is such that they stop short of both the inner and outer ends of the box. The top and bottom walls each have an aperture 34 near the outer end of the box. The aperture receives a latch on the cap to retain the cap in the housing.

Figure 7:
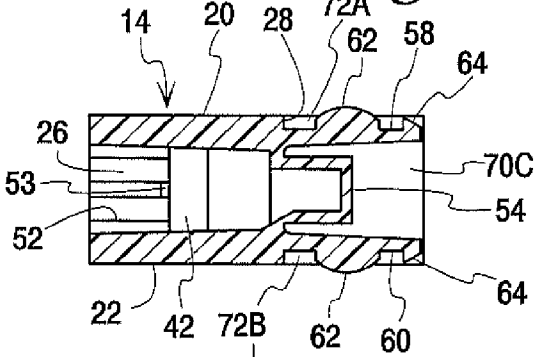
FIG. 7 is a section taken along line 7-7 of FIG. 2.
Figure 5:
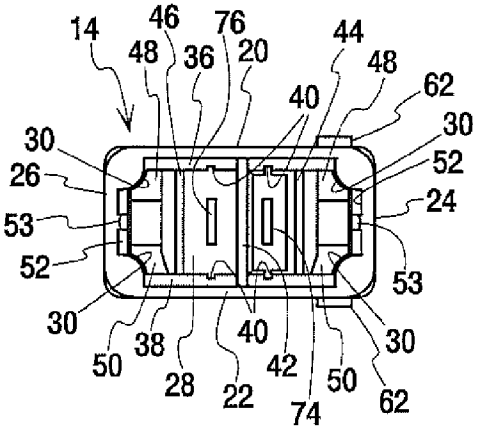
FIG. 5 is a left end elevation view of the housing, looking at the outer end of the housing.
Figure 6:
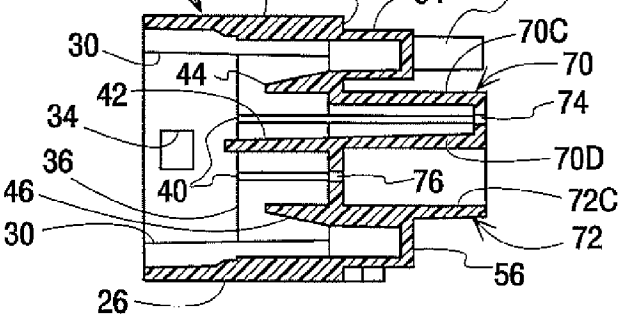
FIG. 6 is a section taken along line 6-6 of FIG. 2.
Figure 9:
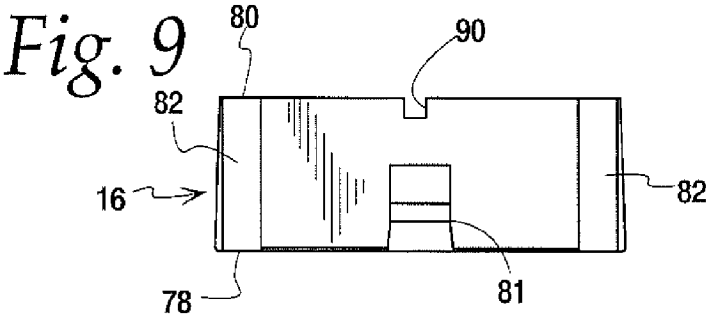
FIG. 9 is a top plan view of the cap.
Figure 12:
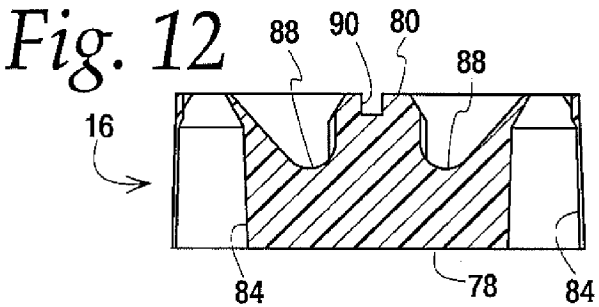
FIG. 12 is a section taken along line 12-12 of FIG. 8.
Figure 8:
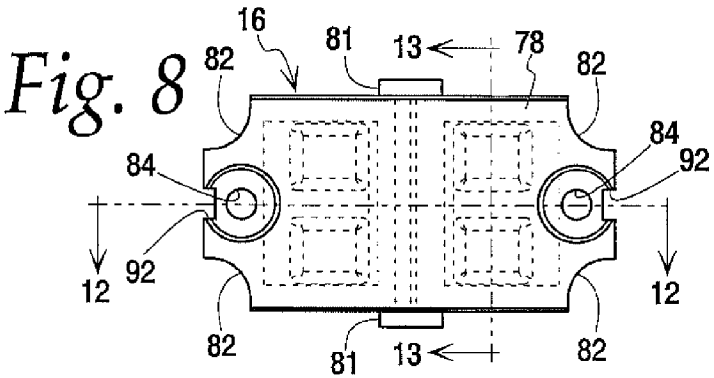
FIG. 8 is an end elevation view of the cap, looking at the outer end of the cap.
Figure 13:
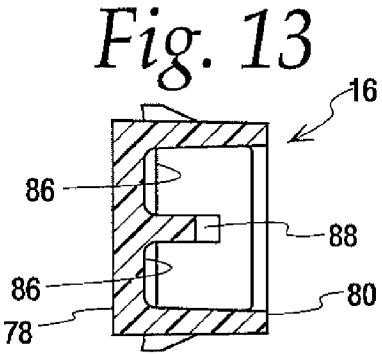
FIG. 13 is a section taken along line 13-13 of FIG. 8.
Figure 10:
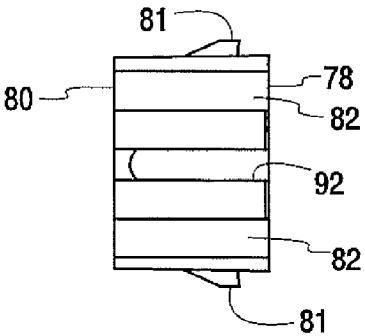
FIG. 10 is a side elevation view of the cap.
Figure 11:
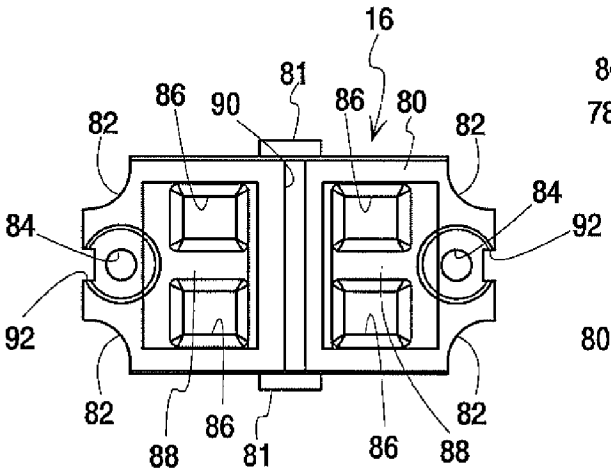
FIG. 11 an end elevation view of the cap, looking at the inner end of the cap.
Figure 16:
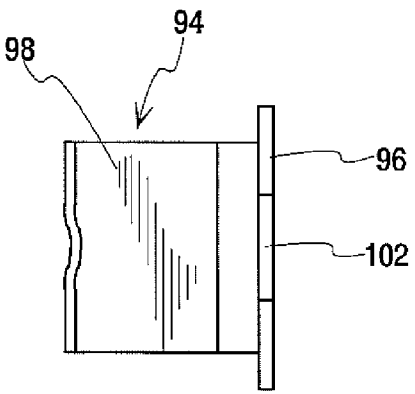
FIG. 16 an end elevation view of the male contact, looking at the inner end
Figure 15:
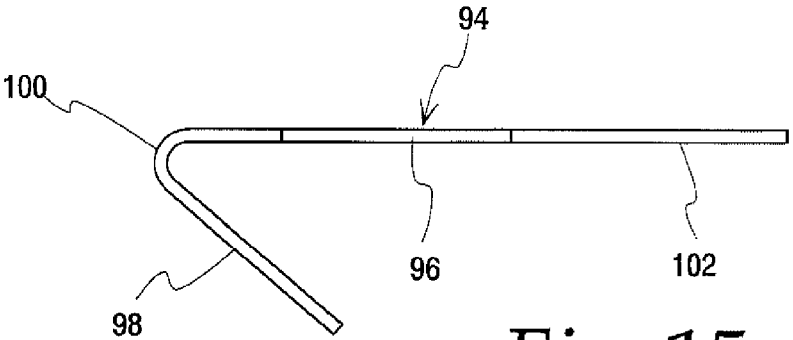
FIG. 15 top plan view of the male contact.
Figure 14:
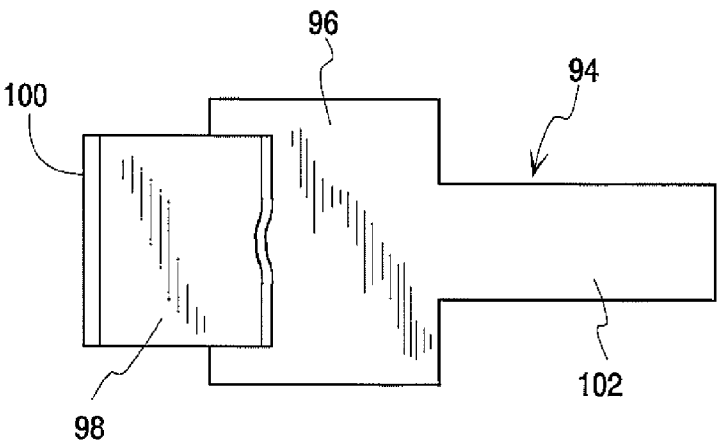
FIG. 14 side elevation view of the male contact.
Figure 17:
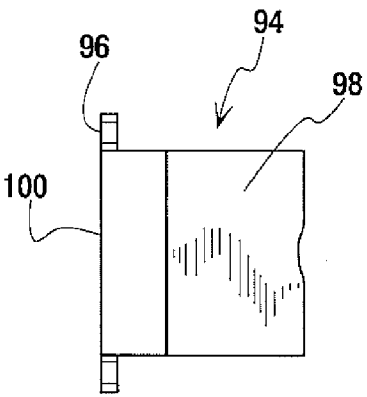
FIG. 17 an end elevation view of the male contact, looking at the outer end.
Figure 21:
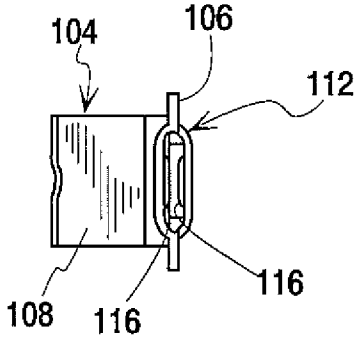
FIG. 21 an end elevation view of the female contact, looking at the inner end.

Internal features of the housing's box structure are shown in FIGS. 5-7. The internal surfaces of both the top and bottom walls have a portion of increased thickness in about the inner half of the box. This forms upper and lower pads 36 and 38. The outer edges of the pads form stops which limit the distance the cap 16 can be pushed into the housing 14. The pads have a pair of slots 40 formed therein. The slots provide guideways for ears on the contacts as will be explained below. The pads are connected by a vertical partition 42. As seen in FIG. 6, the partition extends from the cross wall 28 slightly beyond the pads 36, 38. On either side of the partition are vertical guide walls 44 and 46. The guide walls cooperate with upper and lower sloping surfaces 48 and 50 to direct incoming conductors into wire receptacle boxes 54, 56 which will be described momentarily. The inner surfaces of the side walls 24 and 26 have indentations 52 which receive the side edges on the cap. There is a peg 53 in the middle for engaging the cap. The indentations 52 allow the overall size of the enclosure to be reduced by moving some of the wire port opening from the cap to the housing. This shrinkage of the product reduces the part size and lowers its cost.

Figure 2:
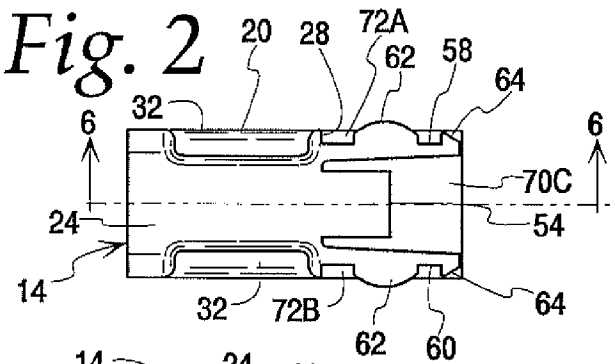
FIG. 2 is a side elevation view of the housing.

Looking now outside the housing's basic box, first and second wire receptacle boxes 54 and 56 extend from the cross wall 28. These boxes define a hollow chamber which communicates with that of the housing box to receive the end of a conductor inserted into the housing. As seen in FIGS. 2 and 7, above and below the first receptacle box are upper and lower flexible latch arms 58, 60. The latch arms are cantilevered from the cross wall 28. Each latch arm includes a rounded button 62 and an upwardly or downwardly facing hook 64.

The hooks are releasably engagable with upper and lower eyelets 66, 68 formed above and below the second receptacle box 56 in a manner which will be explained below.

The inner or forward end of the housing also has first and second extensions 70 and 72 thereon. The extensions are located on opposite sides of a central plane indicated at A in FIG. 4. The first extension 70 is an elongated five-sided structure having top and bottom walls 70A and 70B, a lateral side wall 70C, a medial side wall 70D and an end wall 70E. There is a vertically extending slot 74 in the end wall 70E. The second extension is an elongated three-sided structure having top and bottom walls 72A and 72B and a lateral side wall 72C. The second extension surrounds a vertically extending slot 76 in the cross wall 28. It will be noted in FIGS. 4 and 6 that the second receptacle box 56 shares a wall with the lateral wall 72C whereas the first receptacle box 54 is spaced from the lateral wall 70C. This space receives the lateral side wall 72C of a mating housing when two housings are joined together.

Figure 4:
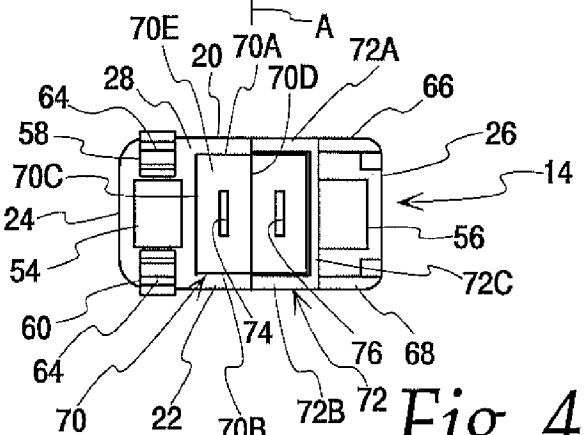
FIG. 4 is a right end elevation view of the housing, looking at the inner end of the housing.

It can be seen in FIG. 4 that the separation between the internal surface of the top and bottom walls 72A and 72B of the second extension is slightly greater than the distance between the outside edges of the top and bottom walls 70A and 70B of the first extension. There is just enough difference to create a light interference fit. Similarly, the distance between the outside surface of the medial wall 70D and the inside surface of the lateral wall 72C is just slightly greater than the distance between the outside surface of the medial wall 70D and the outer surface of the lateral wall 70C, again, just enough to create an interference fit. Thus, when two housings 14 are mated or plugged together, the first enclosure 70 of one housing will fit into the second enclosure 72 of the other housing. Such a mating of two housings will similarly cause flexure of the latch arms 58, 60, allowing the hooks 64 of one housing to engage the eyelets 66, 68 of the other housing. The wire receptacle boxes 54, 56 of such mated housings will be adjacent one another but not engaging. Two mated housings can be released from engagement by pressing on the buttons 62 to flex the hooks out of engagement with the eyelets and then pulling the two housings away from one another.

It will be noted that while the second extension 72 is described as a three-sided structure, the fourth side is essentially closed by the medial wall 70D of the first extension. As will be described below, the first and second extensions receive male and female electrical contacts. Similarly, the first and second wire receptacle boxes 54 and 56 receive the ends of the conductors inserted into the enclosure. Thus, all of the conductive portions of the disconnect are enclosed by portions of the housing and cap. This makes the enclosure finger proof to prevent electric shock hazards but it does not increase the size of the connector in any plane to do so. All four contacts of a disconnect are protected, so an installer can put this in either way and still be protected when opening the disconnect. This arrangement also keeps the wires of similar polarity abutted, other than the thin walls of plastic between them. Also, unlike traditional latch designs that hang out from the connector, the latch arms 58 and 60 are tucked into the vacant space around the wire receptacle boxes 54 and 56. This minimizes the overall profile and minimizes snag points with sheet metal or wires. Thus, the disconnect makes a very efficient use of a minimum amount of space.

Turning now to FIGS. 8-13, details of the cap 16 will be described. The cap is generally a rectangular block with an outer face 78 and an inner face 80. There are latches 81 on the top and bottom of the block. These are engageable with the apertures 34 in the housing to retain the cap in the housing. Various portions of the block are cut away. For example, the outside corners of the block have cutouts 82 which accommodate the fillets 30 of the housing. Tapered wire ports 84 extend through the block. Four depressions 86 are formed in the inner face 80. Between the upper and lower depressions are two arcuate seats 88. These seats receive the knuckle of a contact as will be described below. The inner face also has a vertical groove 90. The groove engages the partition 42 of the housing when the cap 16 is inserted in the housing. Similar grooves 92 in the sides of the block engage the pegs 53.

Details of the male contact 94 are shown in FIGS. 14-17. The contact is made of a suitable, electrically conductive material. It has a central plate 96. At the outer end of the plate the contact has a spring finger 98 folded back on the plate at an angle of about 30° to 50°. An angle of 41° is preferable. The junction between the plate 96 and the spring finger 98 forms a knuckle 100. An elongated blade 102 is formed at the inner end of the plate. When the enclosure is assembled the male contact 94 is inserted into the space between the guide wall 46 and the partition 42. The top and bottom edges of the plate fit into the slots 40 in the upper and lower pads 36, 38. The cross wall limits insertion of the male contact as the plate 96 will not fit through the slot 76. But the blade 102 does extend through the slot 76 into the second extension 72. When the cap 16 is inserted into the housing 14 the knuckle 100 of the male contact is supported in one of the arcuate seats 88 of the cap.

Figure 20:
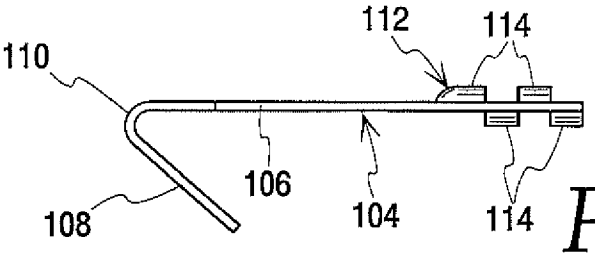
FIG. 20 top plan view of the female contact.
Figure 19:
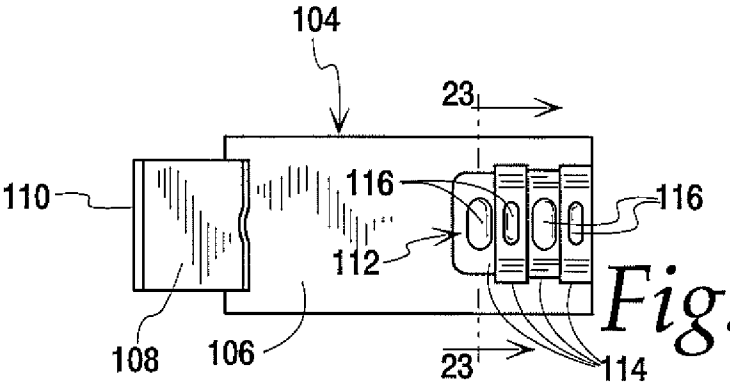
FIG. 19 side elevation view of the female contact.
Figure 23:
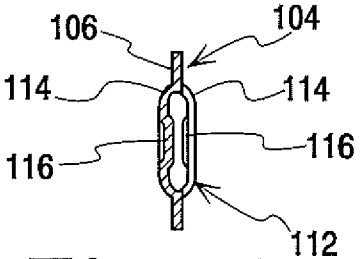
FIG. 23 is a section taken along line 23-23 of FIG. 19.
Figure 22:
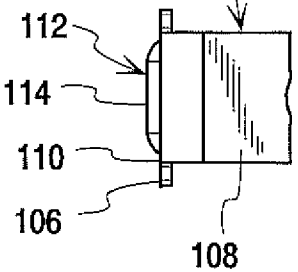
FIG. 22 an end elevation view of the female contact, looking at the outer end.
Figure 18:
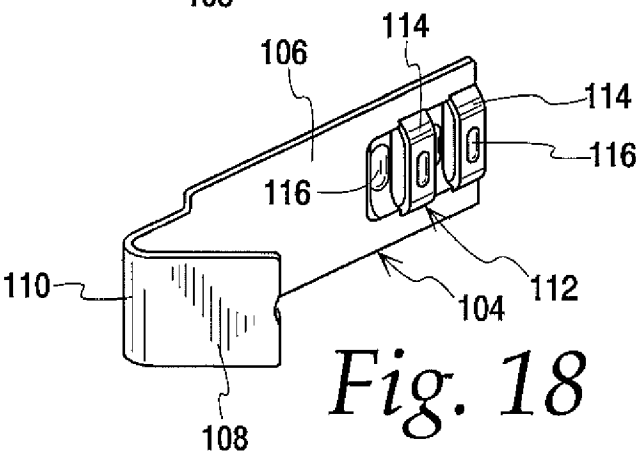
FIG. 18 is a perspective view of the female contact.

Details of the female contact 104 are shown in FIGS. 18-23. The contact is made of a suitable, electrically conductive material. It has an elongated plate 106. At the outer end of the plate there is a spring finger 108 folded back on the plate at an angle of about 30° to 50°. An angle of 41° is preferable. The junction between the plate 106 and the spring finger 108 forms a knuckle 110. A socket 112 is formed at the inner end of the plate. The socket is formed by four tines 114 which are upset out of the plane of the plate 106, although a different number of tines could be used. Adjacent tines are upset in alternately opposite directions as best seen in FIG. 20. An inwardly-directed dimple 116 is formed in the center of each tine. When the enclosure is assembled the female contact 104 is inserted into the space between the guide wall 44 and the partition 42. The top and bottom edges of the plate fit into the slots 40 in the upper and lower pads 36, 38. The socket 112 extends into the first extension 70. When the cap 16 is inserted into the housing 14 the knuckle 110 of the female contact is supported in one of the arcuate seats 88 of the cap.

The use, operation and function of the wire connector are as follows. Connection of a wire 18A or 18B to the enclosure is straightforward. A stripped wire is inserted into the wire port 84 of the cap 16. As the conductor enters the interior of the enclosure 12 it encounters one of the contact fingers 98 or 108 and causes it to flex sideways to permit the conductor to pass. The flexing of the finger causes it to exert pressure on the conductor. Due to the angle of the finger, any tendency to remove the conductor causes the finger to dig into the conductor and hold it in the housing.

Connection of two enclosures 12 is as follows. Two enclosures are placed with their housings in facing relation, with their central planes aligned, as shown in FIG. 1. The housings are oriented so their first extensions are on opposite sides of the central plane. Thus, the first extension 70 of one housing is facing the second extension 72 of the other housing. Due to the placement of the extensions this will necessarily result in the second extension of the one housing facing the first extension of the other housing. Similarly it results in the upper and lower latch arms 58, 60 of the one housing facing the upper and lower eyelets 66, 68, respectively, of the other housing. The user then pushes the two housings together. The first extensions 70 will fit into the second extensions 72. As they do so the blade 102 of each housing will move through the slot 74 of the other housing and into engagement with the socket 112 of the other housing. The blade 102 will first encounter the outermost dimple 116 on the outermost tine 114. If the circuit is live, any arcing will take place on the outermost dimple and necessarily on one side of the blade. Thereafter, as the blade slides into engagement with the dimples of the inner three tines there will be no further arcing. Thus, the inner three tines will remain free of degradation and will make solid electrical contact with the blade. Also, one side of the blade will always remain free of any arcing and make contact with the full section of the blade. This reduces overall resistance in the circuit.

As the housings continue to move together the hooks 64 will engage the eyelets 66, 68. The angled edge of the hook will slide past the hook as the latch arms 58, 60 flex. Once the hooks are past the front edge of the eyelets the latch arms will cause the straight side of the hooks to snap into engagement with an eyelet. This will prevent the housings from inadvertently separating. However, when it is desired to separate the disconnect, a user can press on the buttons 62 of the latch arms 58, 60 and disengage the hooks from the eyelets. With the latch arms depressed and the hooks disengaged, the user can pull the two housings apart. The delatching operation can be performed with one hand, as the buttons 62 allow the user's two fingers to squeeze the buttons, yet the buttons will slip under the user's fingers as the two enclosures are pulled apart by both hands. Once again any arcing at the separating contacts will occur at the outermost tine as the blade makes its exit from the socket.

Figure 24:
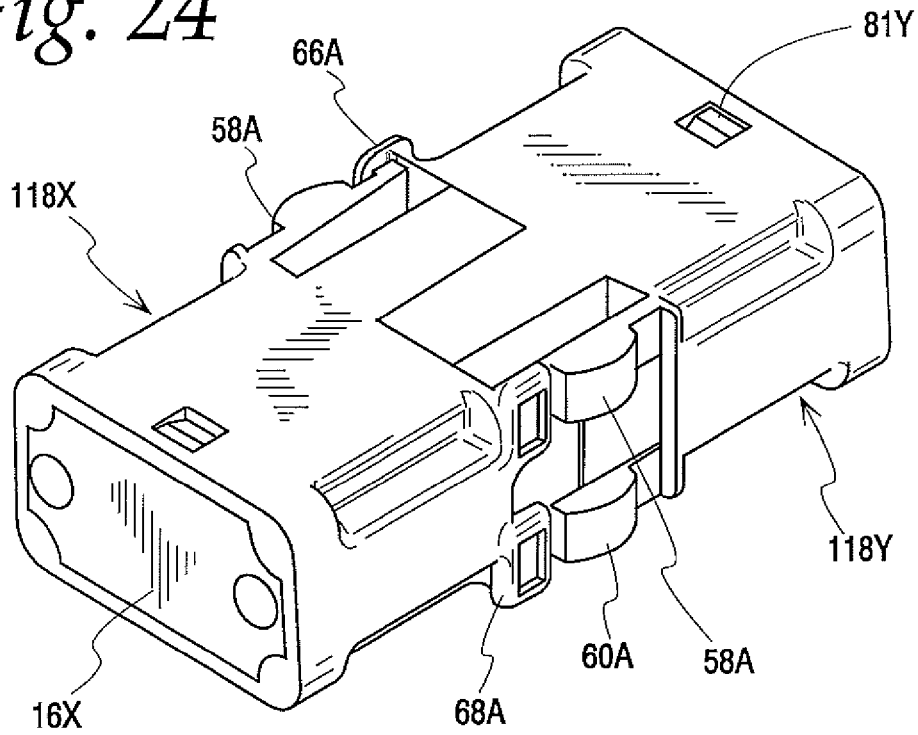
FIG. 24 is a perspective view of an alternate embodiment of the disconnect, showing two connected enclosures with side-mounted release arms
Figure 25:
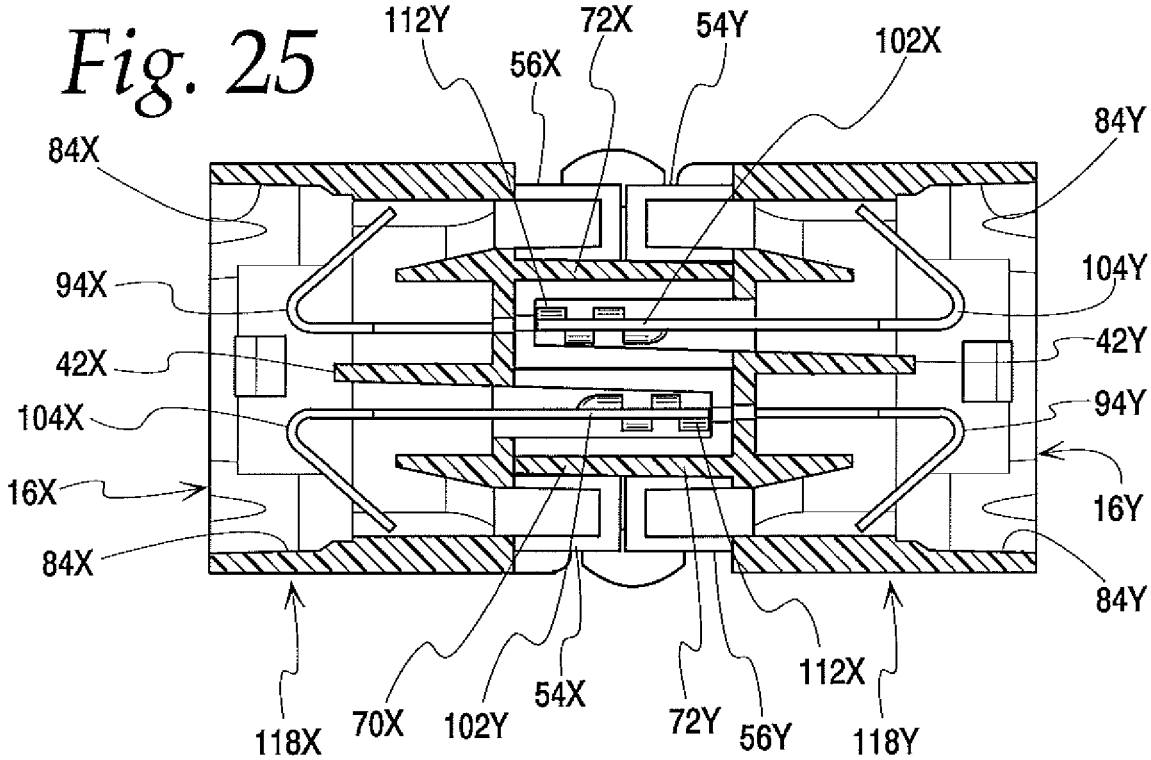
FIG. 25 is a section through joined disconnect enclosures of the type shown in FIG. 24.
Figure 26:
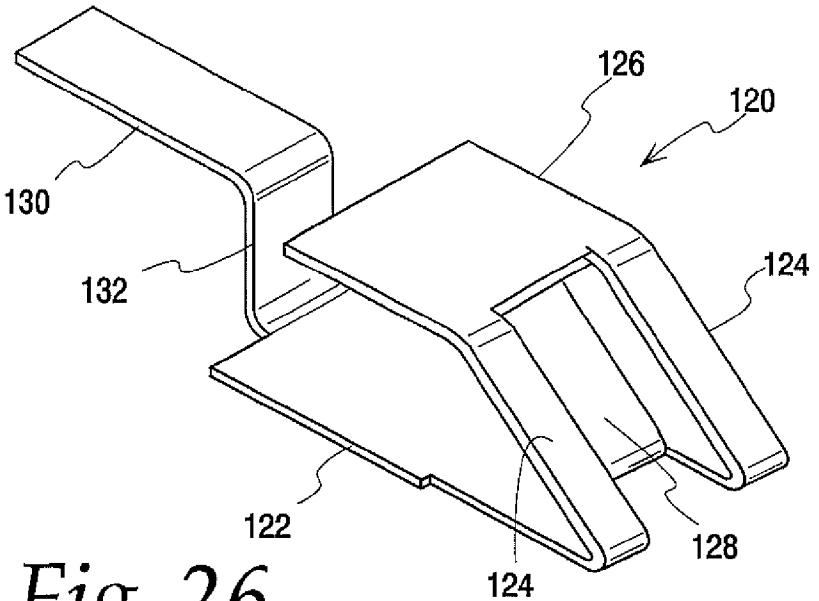
FIG. 26 is a perspective view of an alternate embodiment of the male contact.
Figure 28:
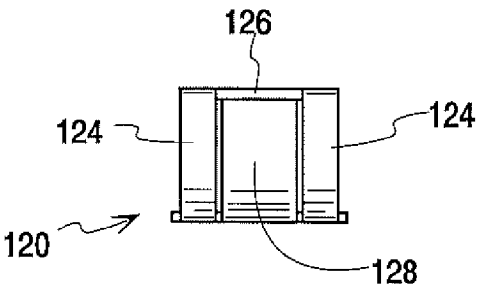
FIG. 28 is an end elevation view of the contact of FIG. 26.
Figure 29:
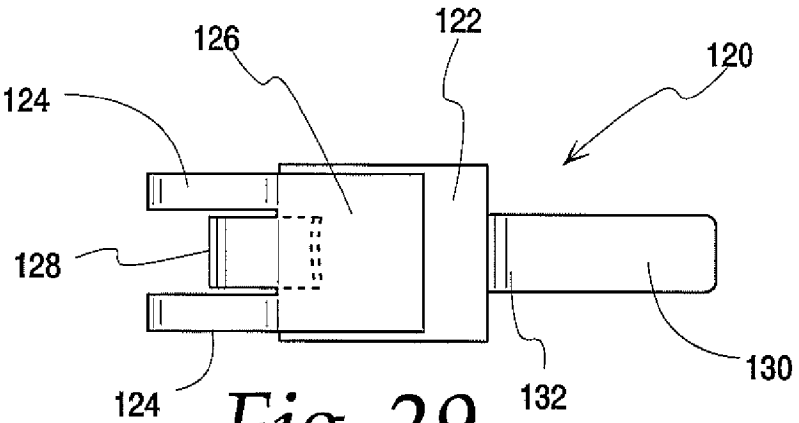
FIG. 29 is a top plan view of the contact of FIG. 28.
Figure 27:
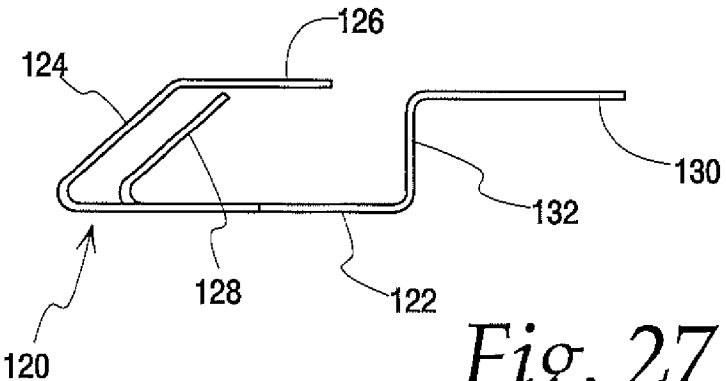
FIG. 27 is a side elevation view of the contact of FIG. 26.

An alternate embodiment of the invention is illustrated in FIG. 24. This embodiment is largely similar to that of FIG. 1. The cap 16 is the same, as are the male and female contacts. The only difference is in the housing 118, wherein the latch arms and eyelets are relocated. Here the latch arms 58A and 60A are arranged on the sides of the housing 118. The eyelets 66A and 68A are similarly rotated to the side position where they engage the hooks on the arms 58A and 60A. FIG. 25 shows the internal arrangement of parts when two housings are connected. Again, except for the side-mounted latch arms, the embodiment of FIG. 1 would look the same as FIG. 25. To assist in differentiating the parts in FIGS. 24 and 25, the suffix X has been added to reference numerals of the left-hand enclosure, while the suffix Y has been added to reference numerals of parts of the right-hand enclosure.

An alternate embodiment of the male contact is shown at 120 in FIGS. 26-29. It has a central plate 122 with a pair of spaced-apart posts 124 at one end thereof. A roof 126 is attached to the posts. In between the posts 124 and underneath the roof 126 a finger 128 is folded back on the central plate. Again the preferred angle of both the posts and the finger to the central plate is 41°, although it could be otherwise. At the end of the plate opposite the posts there is a male blade 130 attached to the plate by an offset 132. The offset locates the blade approximately in line with the underside of the roof. Thus, the blade will generally align with a conductor inserted into the contact. It will be understood that the male contact shown could easily be converted to a female contact by forming a socket such as at 112 in the blade 130. In this form of the contact the inserted conductor will be surrounded on both sides by a metal surface. That is, the inserted bare conductor will be trapped between the finger 128 and the roof 126. The finger will urge the conductor into engagement with the roof. There will be metal-to-metal contact all around. In some applications this may enhance the electrical path between the conductor and the contact, resulting in lower current densities and lower heating of the metallic parts. It also serves to protect the plastic housing parts from heated wires.

Figure 30:
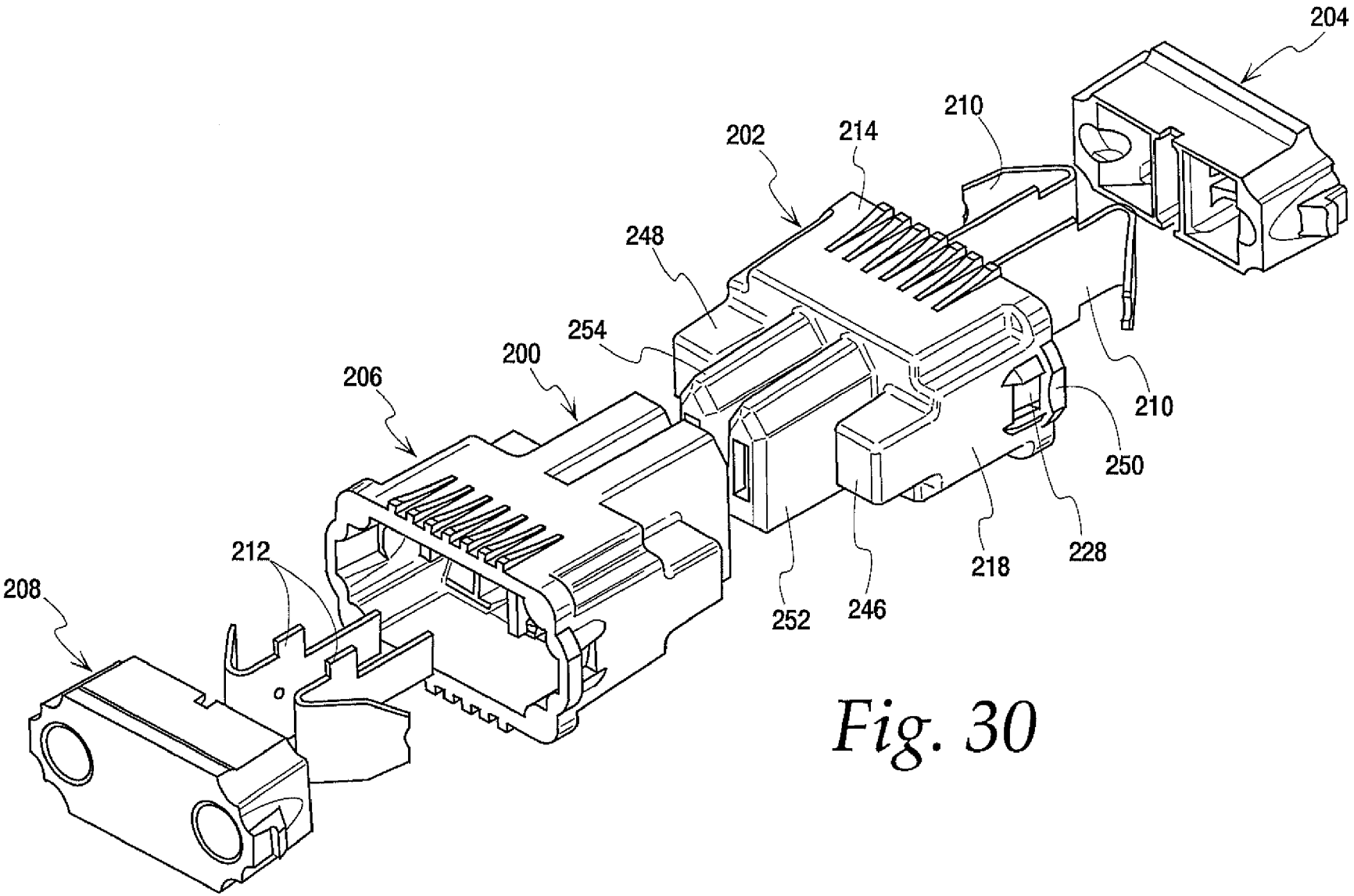
FIG. 30 is an exploded perspective view of a further alternate embodiment of the present invention.

FIG. 30 illustrates yet another embodiment of the electrical disconnect of the present invention generally at 200. The complete disconnect includes two enclosures. A first enclosure includes a first housing 202 and a cap 204. A second enclosure includes a second housing 206 and a cap 208. Each of the housings is a generally five-sided shell with a sixth, outer side that is open to a hollow interior. The caps 204, 208 fit into the shell to close the otherwise open outer end of the housing. The first enclosure has mounted therein a pair of female electrical contacts 210. The contacts each have a wire engaging spring finger at their outer ends and a socket at the inner ends. The second enclosure has mounted in it a pair of male electrical contacts 212. The male contacts each have a wire engaging spring finger at their outer ends and a blade at the inner ends. Extensions at the forward ends of the housings enclose the socket and blade. Wires (not shown in FIG. 30) electrically connect to the contacts with push-in connections. That is, bare conductors at the ends of the wires are pushed into ports in the cap 204, 208 and engage the spring finger of a contact. The housing extensions can be releasably plugged into one another to electrically connect the contacts by joining the blade of one enclosure with the socket of the other enclosure.

Details of the first housing 202 are shown in FIGS. 31-38. Both the first housing 202 and the second housing 206 are similar to the housing 14 except they are not hermaphroditic. The basic structural unit of the housing 202 is a five-sided, hollow box including top and bottom walls 214 and 216. These are joined by side walls 218 and 220. A cross wall 222 completes the box. Internal fillets 224 (FIGS. 34, 36 and 38) at the intersections of these walls strengthen the box and provide a surface against which pins in the molding tool can push the finished housing out of the mold. Cutouts 226 on the exterior corners where the side walls meet the top and bottom walls reduce the amount of material needed to mold the part. The side walls 218, 220 each have an aperture 228 (FIGS. 32, 36, 38) near the outer end of the box. The aperture receives a latch on the cap to retain the cap in the housing.

Figures 31, 32, 33, 34, 35, 36, 37, 38:
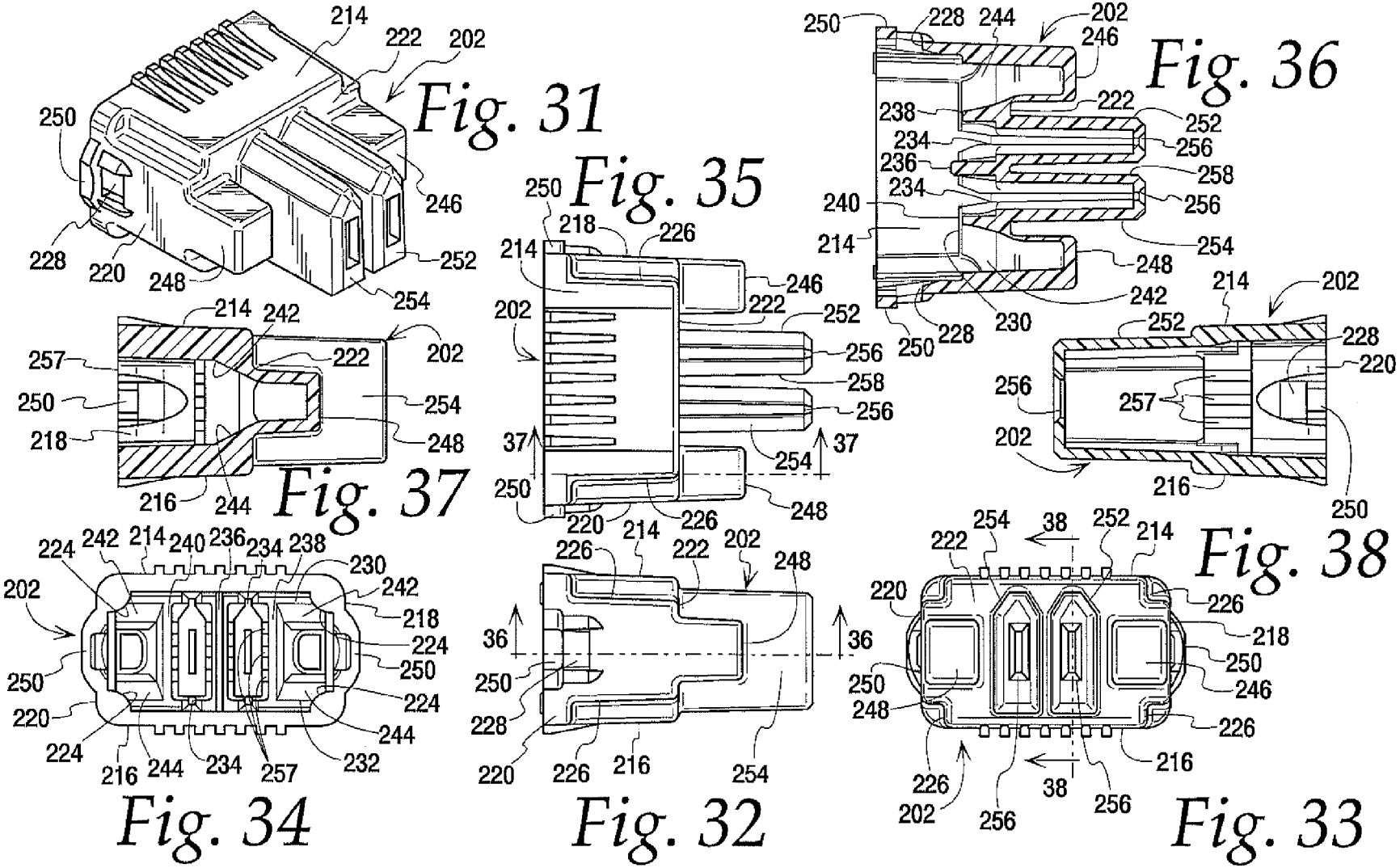
FIG. 31 is a perspective view of a first housing of the disconnect of FIG. 30.
FIG. 32 is a side elevation view of the housing of FIG. 31.
FIG. 33 is a front end elevation view of the housing.
FIG. 34 is a rear end elevation view of the housing.
FIG. 35 is a top plan view of the housing.
FIG. 36 is a section taken along line 36-36 of FIG. 32.
FIG. 37 is a section taken along line 37-37 of FIG. 35.
FIG. 38 is a section taken along line 38-38 of FIG. 33.
Figures 39, 40, 41, 42, 43, 44, 45, 46:
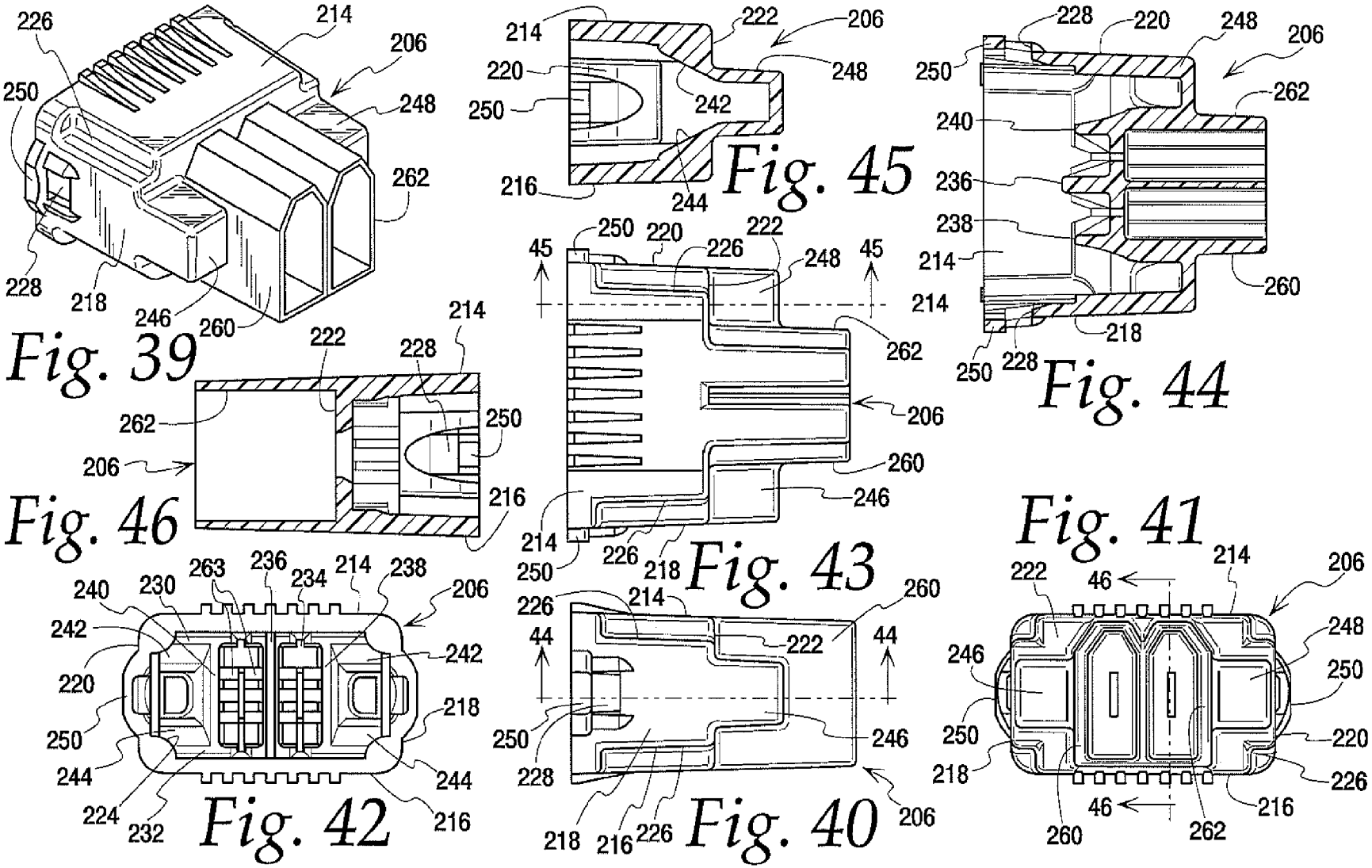
FIG. 39 is a perspective view of a second housing of the disconnect of FIG. 30.
FIG. 40 is a side elevation view of the housing of FIG. 39.
FIG. 41 is a front end elevation view of the housing.
FIG. 42 is a rear end elevation view of the housing.
FIG. 43 is a top plan view of the housing.
FIG. 44 is a section taken along line 44-44 of FIG. 40.
FIG. 45 is a section taken along line 43-43 of FIG. 43.
FIG. 46 is a section taken along line 46-46 of FIG. 41.
Figure 53:
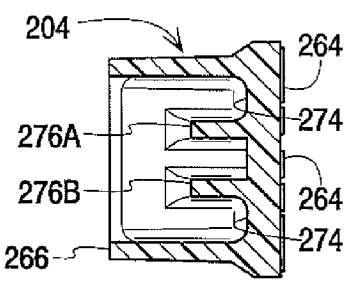
FIG. 53 is a section taken along line 53-53 of FIG. 50.
Figure 51:
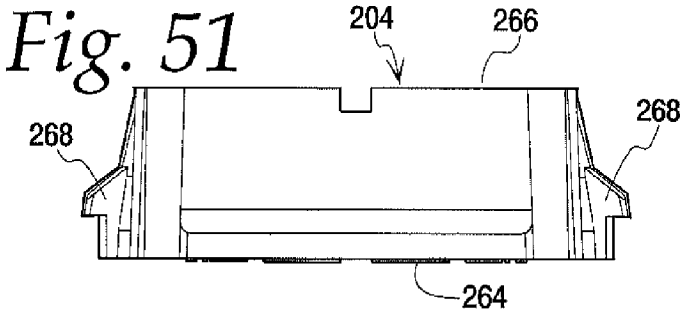
FIG. 51 is a top plan view of the cap.
Figure 52:
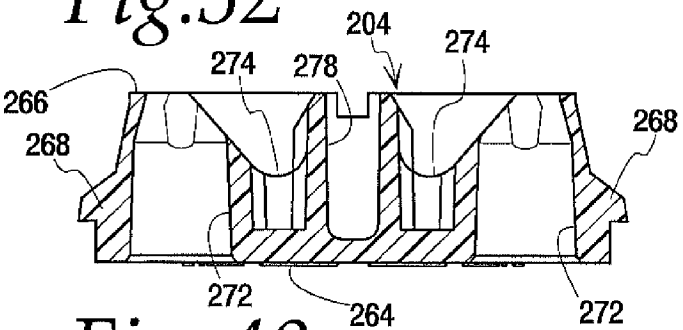
FIG. 52 is a section taken along line 52-52 of FIG. 50.
Figure 50:
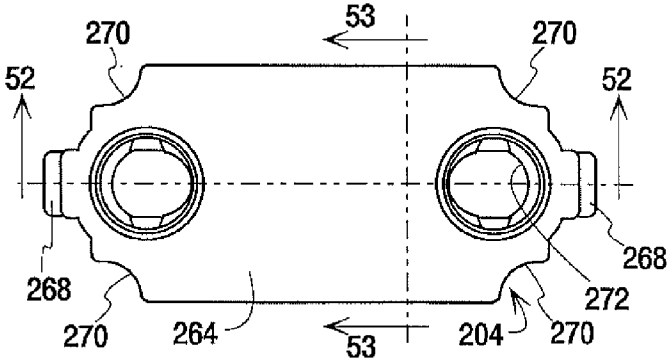
FIG. 50 is a rear end elevation view of the cap.
Figure 48:
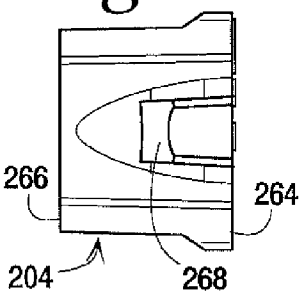
FIG. 48 is a side elevation view of the cap.
Figure 47:
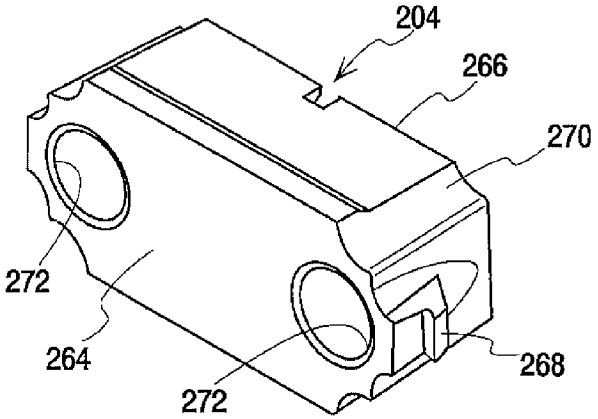
FIG. 47 is a perspective view of a cap of the disconnect of FIG. 30.
Figure 49:
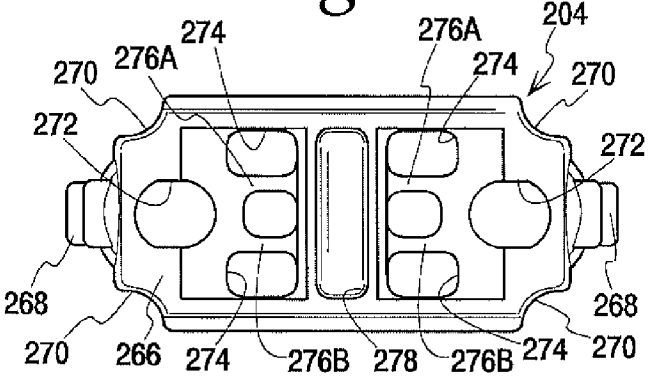
FIG. 49 is a front end elevation view of the cap.
Figure 54:
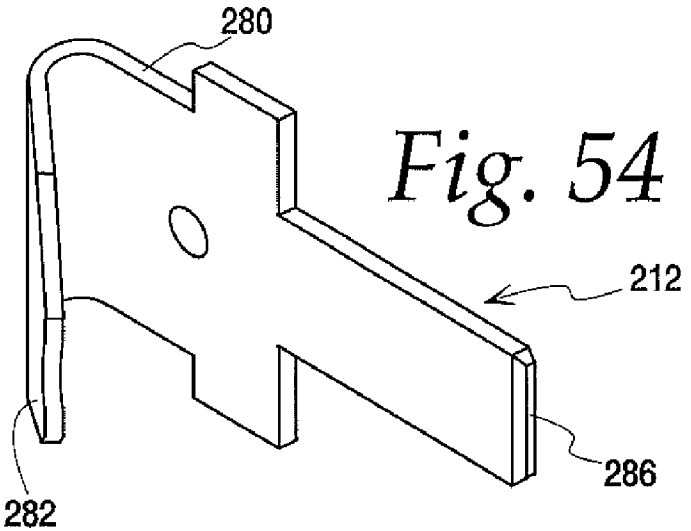
FIG. 54 is a perspective view of the male contact of the FIG. 30 disconnect.
Figure 58:
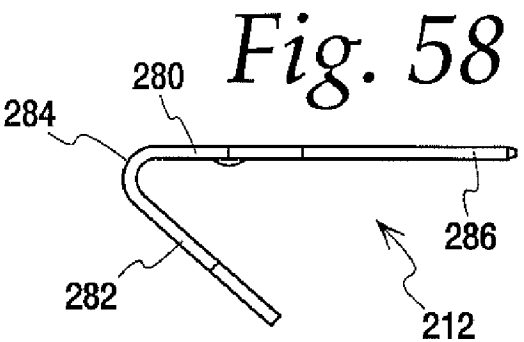
FIG. 58 is a top plan view of the male contact.
Figure 55:
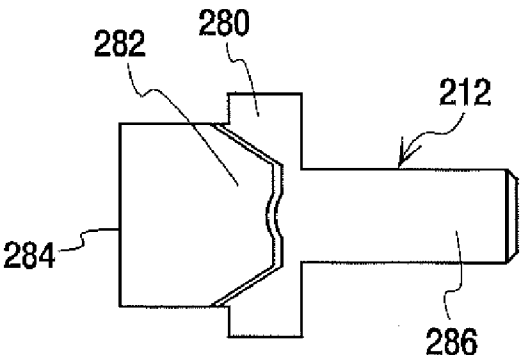
FIG. 55 is a side elevation view of the male contact.
Figure 57:
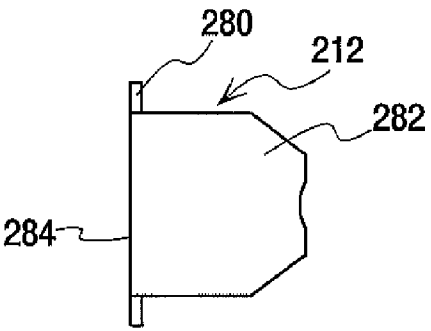
FIG. 57 is a left end elevation view of the male contact.
Figure 56:
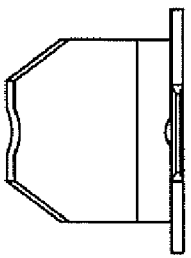
FIG. 56 is a right end elevation view of the male contact.

Internal features of the housing's box structure are shown in FIGS. 34 and 36-38. The internal surfaces of the both the top and bottom walls have a portion of increased thickness in about the inner half of the box. This forms upper and lower pads 230 and 232. The outer surfaces of the pads form stops which limit the distance the cap 204 can be pushed into the housing 202. The pads have a pair of slots 234 formed therein. The slots provide guideways for ears on the contacts as will be explained below. The pads are connected by a vertical partition 236. As seen in FIG. 36, the partition extends from the cross wall 222 slightly beyond the pads 230, 232. On either side of the partition are vertical guide walls 238 and 240. The guide walls cooperate with upper and lower sloping surfaces 242 and 244 to direct incoming conductors into wire receptacle boxes 246, 248 which will be described momentarily. The side walls 218 and 220 have straps 250 spanning the apertures 228. The straps engage latches on the cap to hold it in the housing.

Looking now outside the housing's basic box, first and second wire receptacle boxes 246 and 248 extend from the cross wall 222. These boxes define a hollow chamber or seat which communicates with the interior of the housing box to receive the end of a conductor inserted into the housing. The seat constrains a conductor to a confined area. This is particularly important with stranded conductors because it prevents the conductors from flattening out or splaying, which if it occurred could cause a reduction in the holding force of the push-in connector elements. The guide walls 238, 240 have another function and that is to limit deflection of the spring fingers of a contact element. That is, it is desired that the disconnect of this invention be usable with wires ranging in size from 12 AWG to 18 AWG. With the larger wire sizes it may be possible to cause plastic deformation of the spring fingers during insertion of the wire. The guide walls 238, 240 are disposed in the path of spring finger movement to limit flexure of the spring fingers to an amount no more than their elastic limit.

The inner or forward end of the housing also has first and second extensions 252 and 254 thereon. The extensions are located on opposite sides of a longitudinal axis of the housing. The extensions are generally five-sided structures which have a peak at the upper portion and define a vertically extending slot 256 at the forward end. The extensions are hollow and define compartments in which the female contacts are disposed. Entry of the contacts into the extensions is facilitated by a plurality of small, sloping ribs 257 on the facing surfaces of the guide walls 238, 240 and the partition 236. The ribs funnel the female contacts into the extensions 252, 254. It will be noted in FIGS. 33 and 35 that the wire receptacle boxes 246, 248 are spaced from the extensions 252, 254 and that there is a gap 258 between the extensions.

Details of the second housing 206 are shown in FIGS. 39-46. The basic box structure of housing 206 and the interior thereof are essentially the same as in the first housing 202. Accordingly, the description of these parts will not be repeated. Like parts are given like reference numerals from the description of the first housing. The only significant differences between the first and second housings are in the second housing's extensions 260, 262. These are generally five-sided structures having a shape similar to that of the first housing except they have an open forward end and are enlarged to enable the first housing extensions 252, 254 to fit inside the extensions 260, 262. At the inner ends the extensions terminate at the cross wall 222. There are slots 261 in the cross wall at the base of the extensions. On the interior side of the cross wall a plurality of sloping ribs 263 serve to guide a male contact blade into and through the slots 261 and into the extensions 260, 262. Note the peak along the top edge of the extensions provides a polarizing feature which prevents putting the two housings together backwards. The extensions 260, 262 define compartments in which the male contacts are received.

It will be noted that the compartment walls of the extensions in both housing are disposed between any two contacts to prevent direct access between adjacent contacts. In other words, any imaginary line transverse to the axis of the housing that intersects two contacts passes through at least one compartment wall. There is no direct path from one contact to the adjacent contact due to the intervening presence of the compartment walls. This is true whether the housings are engaged or disengaged with one another. This provides an extra measure of protection against shorting of the contacts, regardless of which housing is connected to the power supply or the load.

Turning now to FIGS. 47-53, details of the caps 204 and 208 will be described. The cap 208 is the same as cap 204 and both are similar to cap 16. The cap 204 is generally a rectangular block with an outer face 264 and an inner face 266. There are latches 268 on the outer sides of the block. These fit into the apertures 228 in the housing after the cap is inserted therein. The latches engage the straps 250 to retain the cap in the housing. Various portions of the block are cut away. For example, the outside corners of the block have cutouts 270 which accommodate the fillets 224 of the housing. Tapered wire ports 272 extend through the block. Four depressions 274 are formed in the inner face 266. Pairs of arcuate seats 276A, 276B are located between the upper and lower depressions. These seats receive the knuckle of a contact as will be described below. The inner face also has a vertical groove 278. The groove engages the partition 236 of the housing when the cap 204 is inserted in the housing.

Details of the male contacts 212 are shown in FIGS. 54-58. The contact is made of a suitable, electrically conductive material such as 510, 511 or 519 phosphorous bronze, spring temper. It has a central plate 280. At the outer end of the plate the contact has a spring finger 282 folded back on the plate at an angle of about 37° to 43°. An angle of 41° is preferable. The junction between the plate 280 and the spring finger 282 forms a knuckle 284. An elongated blade 286 is formed at the inner end of the plate. When the enclosure is assembled the male contacts 212 are inserted into the second housing 206 in the space between the guide walls 238, 240 and the partition 236. The top and bottom edges of the plate fit into the slots 234 in the upper and lower pads 230, 232. The blade 286 is guided into the slot 261 by the ribs 263. The cross wall 222 limits insertion of the male contact as the plate 280 will not fit through the slot 261. But the blade 286 does extend through the slot 261 into one of the extensions 260, 262. When the cap 208 is inserted into the housing 206 the knuckle 284 of the male contact is supported in one of the pairs of arcuate seats 276A, 276B of the cap.

Details of the female contact 210 are shown in FIGS. 59-64. It is quite similar to female contact 104. The contact 210 is made of the same electrically conductive material as contact 212. It has an elongated plate 288. At the outer end of the plate there is a spring finger 290 folded back on the plate at an angle of about 39° to 43°. An angle of 41° is preferable. The junction between the plate 288 and the spring finger 290 forms a knuckle 292. A socket 294 is formed at the inner end of the plate. The socket is formed by four tines 296 which are upset out of the plane of the plate 288, although a different number of tines could be used. Adjacent tines are upset in alternately opposite directions as best seen in FIG. 63. An inwardly-directed dimple 298 is formed in the center of each tine. When the enclosure is assembled the female contact 210 is inserted into the first housing 202 in the space between the guide walls 238, 240 and the partition 236. The top and bottom edges of the plate fit into the slots 234 in the upper and lower pads 230, 232. The sockets 294 extend into the extensions 252, 254. When the cap 204 is inserted into the housing 202 the knuckle 292 of the female contact is supported in one of the pairs of arcuate seats 276A, 276B of the cap.

Figure 65:
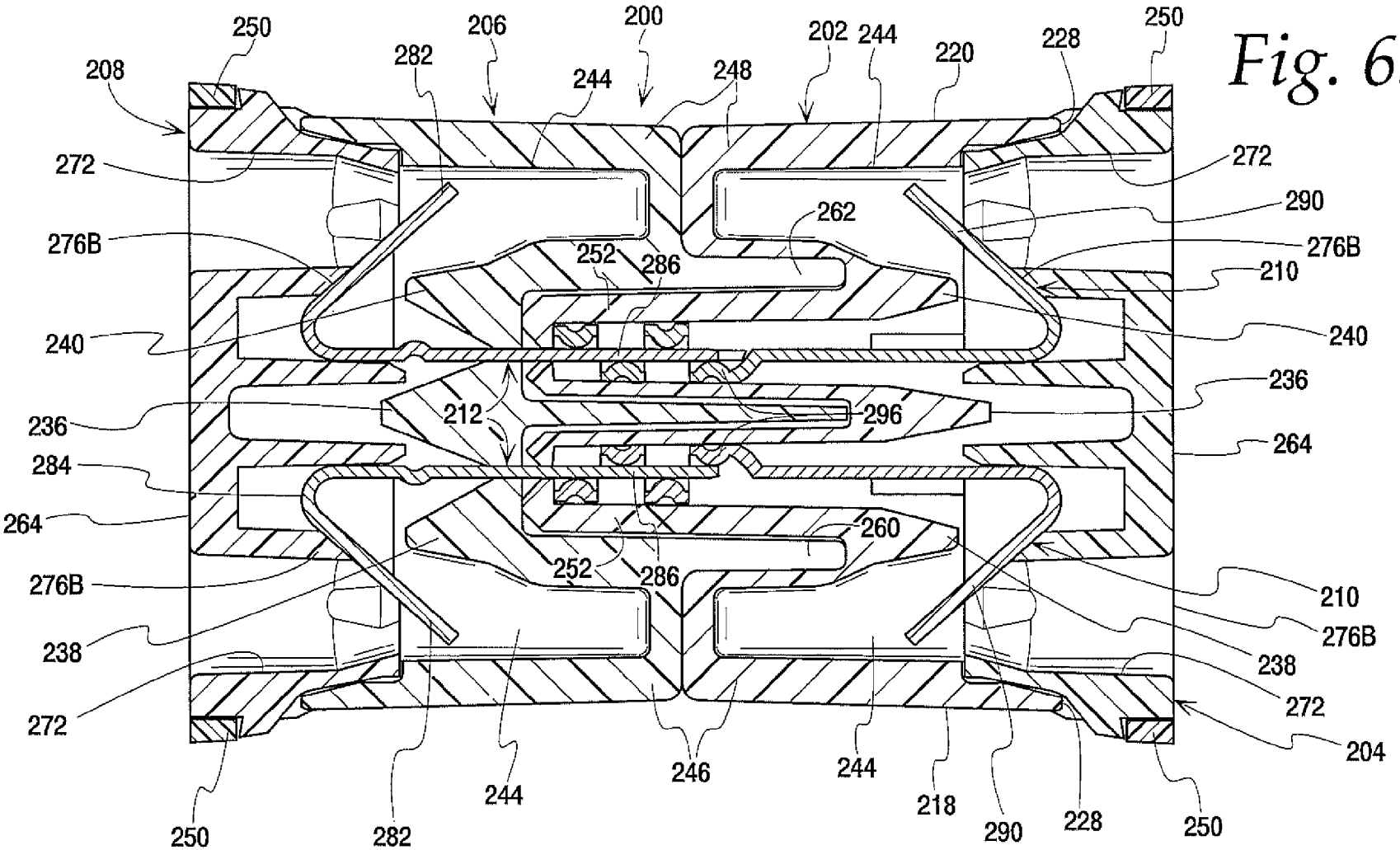
FIG. 65 is a longitudinal section taken through the assembled disconnect.

The use, operation and function of the wire connector are as follows. Connection of a wire to the enclosure is straightforward. A stripped wire is inserted into the wire port 272 of the cap 204 or 208. As the conductor enters the interior of the housing 202 or 206 it encounters one of the contact spring fingers 282 or 290 and causes it to flex sideways to permit the conductor to pass. The flexing of the spring finger causes it to exert pressure on the conductor. Due to the angle of the spring finger, any tendency to remove the conductor causes the spring finger to dig into the conductor and hold it in the housing. Note in FIG. 65 that the guide walls 238, 240 have another function and that is to limit deflection of the spring fingers of a contact element. That is, it is desired that the disconnect of this invention be usable with wires ranging in size from 12 AWG to 18 AWG. With the larger wire sizes it may be possible to cause plastic deformation of the spring fingers during insertion of the wire. The guide walls 238, 240 are disposed in the path of spring finger movement to limit flexure of the spring fingers to an amount no more than their elastic limit.

Connection of the two housings 202, 206 is as follows. The two housings are placed in facing relation, with their central planes aligned, as shown in FIG. 30. The male extensions 252, 254 of housing 202 are facing the female extensions 260, 262 of the other housing 206. The user then pushes the two housings together. The male extensions 252, 254 will fit into the female extensions 260, 262. As they do so the blade 286 of the male contacts will move through the slots 256 of the other housing and into engagement with the socket 294 of the female contacts 210 in the male housing 202. As in the case of the embodiment of FIG. 1, the blade 286 will first encounter the outermost dimple 298 on the outermost tine 296. If the circuit is live, any arcing will take place on the outermost dimple and necessarily on one side of the blade 286. Thereafter, as the blade slides into engagement with the dimples of the inner three tines there will be no further arcing. Thus, the inner three tines will remain free of degradation and will make solid electrical contact with the blade. Also, one side of the blade will always remain free of any arcing and make contact with the full section of the blade. This reduces overall resistance in the circuit.

When it is desired to separate the disconnect, a user can simply pull the two housings apart. Once again any arcing at the separating contacts will occur at the outermost tine as the blade makes its exit from the socket.

While the preferred form of the invention has been shown and described herein, it should be realized that there may be many modifications, substitutions and alterations thereto. For example, while the housing shown accommodates connections of one wire pair, other numbers of compartments and contacts could be used to connect different numbers of wire pairs. There may be times when a disconnect may be used just for a hot wire, in which case only a single contact in each enclosure is needed. Also, while the first and second extensions are shown each touching the central plane, they could be spaced therefrom, so long as they are equally spaced from the central plane. Along these same lines, although the housing shown is hermaphroditic in that it contains both male and female contacts, it need not always be so. There may be instances where all the female contacts could be in one enclosure and all the male contacts could be in the other enclosure, as in the FIG. 30 embodiment. That is, some applications may require that the product be marked as "hot" or "neutral" and a hermaphroditic design does not allow for this. This would require some alteration of the contacts and minimal alteration of the housing, perhaps widening the slot 74 to permit entry of a female contact into the first enclosure 70. Another alternative embodiment could be rounded caps that give the product a torpedo shape. This could be an advantage if these are installed by the ballast manufacturers. The ballasts with wire leads and disconnects could lead to tangling of the various wires. Torpedo shaped disconnects would more easily break free.

We claim:

1. An electrical disconnect, comprising:

first and second housings defining a longitudinal axis along which the housings are movable to engage and disengage one another, each housing having at least one extension extended outwardly therefrom with a compartment defined therein, each housing having at least one electrical contact disposed entirely therein;

a resilient finger in each housing configured to exert pressure on a conductor of a stripped end of a wire when the conductor is inserted into the respective housing;

each extension of the first housing being defined by connected side walls that continuously surround the compartment and including an end wall that encloses at least a portion of the compartment and defines a slot;

each extension of the first housing being slidably received within a corresponding extension of the second housing; and a front portion of the at least one contact of the second housing extending through the slot in the end wall of the at least one extension of the first housing for releasable electrical engagement with the at least one contact in the first housing when the first and second housings are engaged.

2. The electrical disconnect of claim 1 wherein the slot is sized to receive only the front portion of the contact of the second housing.

3. The electrical disconnect of claim 1 wherein the front portion of the contact of the first housing has at least one tine defining a socket, the socket being axially aligned with the slot.

4. An electrical disconnect, comprising:

first and second connector housings defining a longitudinal axis along which the housings are movable to engage and disengage one another, each housing having at least one extension with a compartment defined therein and each extension of the first housing being slidably received within a corresponding at least one extension of the second housing;

an electrical contact mounted in each compartment of the first and second housings, each contact of one of the first and second housings being releasably electrically engageable with a counterpart contact in the other of the first and second housings;

each housing having at least one wire receptacle box, the wire receptacle box being disposed in the path of a conductor formed by a conductive, stripped end of a wire and the wire receptacle box being adapted to receive the conductor when the conductor is inserted into the housing;

the wire receptacle box of at least one of the first and second housings being spaced from the extension of said at least one housing to define a gap between the wire receptacle box and the extension of said at least one housing with the gap being sized to receive a portion of the extension of the other of the first and second housings when the first and second housings are engaged; and wherein an end wall of the wire receptacle box of the first housing is facing the end wall of the counterpart wire receptacle box of the second housing when the housings are engaged.

5. An electrical disconnect, comprising:

first and second connector housings defining a longitudinal axis along which the housings are movable to engage and disengage one another, each housing having at least one extension with a compartment defined therein with each extension of the first housing being defined by connected side walls that continuously surround the compartment and including an end wall that encloses at least a portion of the compartment and defines a slot, and each housing having at least one electrical contact disposed entirely therein;

each contact of one of the first and second housings being releasably electrically engageable with a counterpart contact in the other of the first and second housings;

each housing having at least one wire receptacle box disposed in the path of a conductor formed by a conductive, stripped end of a wire and the wire receptacle box being adapted to receive the conductor when the conductor is inserted into the housing, the wire receptacle boxes each having an end wall and being positioned such that when the housings are engaged the end wall of the wire receptacle box of the first housing and the end wall of a counterpart wire receptacle box of the second housing are coplanar in a plane transverse to the longitudinal axis; and wherein the end wall of the wire receptacle box of the first housing is facing the end wall of the counterpart wire receptacle box of the second housing when the housings are engaged.

6. An electrical disconnect, comprising:

first and second housings defining a longitudinal axis along which the housings are movable to engage and disengage one another, each housing having at least one extension extended outwardly therefrom with a compartment defined therein, with each extension of the first housing being defined by connected side walls that continuously surround the compartment and including an end wall that encloses at least a portion of the compartment and defines a slot, each housing having at least one electrical contact disposed entirely therein;

a resilient finger in each housing configured to exert pressure on a conductor of a stripped end of a wire when the conductor is inserted into the respective housing;

each extension of the first housing being slidably received within a corresponding extension of the second housing;

a front portion of the contact of the second housing extending through the slot of the first housing for releasable electrical engagement with the contact in the first housing when the first and second housings are engaged, and the contact within the first housing including at least one tine being oriented transverse to the longitudinal axis and defining a socket that receives the contact of the second housing when the housings are engaged.

7. The electrical disconnect of claim 5 wherein the wire receptacle box of at least one of the first and second housings is spaced from the extension of said at least one housing to define a gap between the wire receptacle box and the extension of said at least one housing with the gap being sized to receive a portion of the extension of the other of the first and second housings when the first and second housings are engaged.

* * * * *